United States Patent [19]

Smith, Jr. et al.

[11] 4,268,708

[45] May 19, 1981

[54] APPARATUS FOR VACUUM SINTERING AND HOT ISOSTATIC PRESSING

[75] Inventors: Charles W. Smith, Jr., Fairview; Franz X. Zimmerman, Erie, both of Pa.

[73] Assignee: Autoclave Engineers, Inc., Erie, Pa.

[21] Appl. No.: 31,541

[22] Filed: Apr. 19, 1979

[51] Int. Cl.[3] ..... F27D 11/00; F27D 7/06

[52] U.S. Cl. ..... 13/20; 13/31 R; 219/390

[58] Field of Search ..... 13/20, 22, 25, 31; 219/406, 546, 390, 408

[56] References Cited

U.S. PATENT DOCUMENTS 3,414,661 12/1968 Reed ..... 13/25 X 3,984,614 10/1976 Isaksson ..... 13/25 X

*Primary Examiner*—Roy N. Envall, Jr.

*Attorney, Agent, or Firm*—Webb, Burden, Robinson & Webb

[57] ABSTRACT

Apparatus for treating a workpiece at elevated temperatures both under vacuum and under superatmospheric pressures to provide for vacuum sintering and hot isostatic pressing in the same apparatus. The apparatus according to this invention comprises a vacuum-pressure vessel and a furnace within the vessel having a pedestal upon which the hearth rests extending up into the furnace. A first electrical heating means spaced about the pedestal is entirely below the hearth. At least one second electrical heating means is spaced about the workspace above the hearth. Means for separately controlling the first and second electrical heating elements are provided. The furnace can provide substantial uniform temperature distribution to the workpiece resting upon the hearth when the vessel is evacuated by direct radiation from the electrical heating means above the hearth. When the vessel is pressurized, uniform temperature distribution is maintained by convection from the electrical heating means below the hearth.

11 Claims, 3 Drawing Figures

APPARATUS FOR VACUUM SINTERING AND HOT ISOSTATIC PRESSING

BACKGROUND

This invention relates to an autoclave furnace especially suitable for use in processes for vacuum sintering of materials followed by hot isostatic pressing. Sintered bodies of near theoretical density may be prepared from particulate matter by sintering under vacuum until open interconnecting porosity connected with the surface has been eliminated and thereafter by hot isostatic pressing until the remaining porosity is removed. The current state of the art is to sinter a partially dense body in a separate vacuum furnace and attain 95% theoretical density; then hot isostatic pressing until achieving 100% theoretical density. The process is old and is taught, for example, in U.S. Pat. No. 3,562,371. However, the process has had a drawback in that separate furnaces were required for the vacuum sintering and the hot isostatic pressing steps. Either a very hot workpiece was transferred from one furnace to another or the workpiece was allowed to cool down prior to transfer. It may be necessary to cool prior to transfer as the sintered workpiece may not be able to stand the thermal shock induced during the hot transfer. Cooling down prior to transfer results in a loss of energy, increases the time required to complete the fabrication process and can change the crystalline characteristics of the sintered body.

This invention relates to a single furnace that may be used for both the vacuum sintering and the hot isostatic pressing steps in the above described process. During the vacuum sinter, the ambient conditions within the workspace of the furnace may be, for example, 1500° C. and a vacuum of $5\times10^{-1}$ torr. During hot isostatic pressing, the ambient conditions within the workspace may be, for example, 1400° C. and 800 to 1200 bar.

Maintaining uniform temperature in the workspace under vacuum conditions and under pressure conditions requires substantially different approaches. With a vacuum in the furnace, heat can only be transferred by radiation and cannot be transferred by convection. Heat is spread equally in all directions by radiation requiring equal insulation in all directions from the heating elements and workspace. When the furnace is pressurized for isostatic pressures, the heat is mainly transferred by convection which continually tends to move heat upwardly in the workspace. This has both advantages and disadvantages. An advantage, for example, of convection heating is that the bottom of the furnace can be much less heavily insulated and the space just below the bottom of the furnace can be used for a number of functions. For example, the space just below the furnace may be used to contain electrical connections that could not withstand the temperatures within the workspace. However, it is a constant challenge with a pressurized furnace to maintain temperature uniformity in the workspace. These considerations bear upon why the vacuum sintering hot isostatic process has heretofore required separate treating furnaces.

It is an advantage of this invention to provide a single furnace for vacuum sintering and hot isostatic pressing which furnace establishes a uniform heat distribution both when evacuated and when pressurized. The furnace is uniquely structured to enable vapors (outgassing contaminants) that are removed from the workpiece during heat-up and vacuum sintering to be drawn out of the furnace without contacting the heating elements and other functional structure within the furnace that might be damaged thereby. It is yet another advantage of this invention to provide a cold trap within the furnace vessel to condense and collect vapors which might otherwise foul the evacuation system.

It is an advantage of the apparatus claimed herein that the vacuum sintering-hot isostatic pressing process can be practiced less expensively and more expediently. Time and energy is saved by loading and heating but one furnace for both steps. Less capital equipment is required and less auxiliary equipment such as temperature controllers is required.

SUMMARY OF THE INVENTION

Apparatus according to this invention for treating a workpiece at elevated temperatures both under vacuum and under superatmospheric pressure comprises a vessel for maintaining either a vacuum or pressurized atmosphere therein, i.e., a vacuum-pressure vessel. Within the vacuum-pressure vessel is a furnace. The furnace comprises a hood insulating the vessel from the workspace and an insulating furnace bottom having a pedestal extending up into the furnace and having a hearth setting thereupon. A first electrical heating circuit comprising electrical resistance heating elements is spaced about the pedestal entirely below the hearth. At least one second electrical heating circuit comprised of electrical resistance heating elements is spaced about the workspace above the hearth. Controllers for separately controlling the first and at least one second electrical heating circuits are provided. The apparatus is arranged to be connected to a source of pressurizing gas and/or a pump for pressurizing the vessel with a selected atmosphere and to a vacuum pump for evacuating the vessel to create a vacuum therein.

The furnace can provide substantially uniform temperature distribution to the workpiece upon the hearth, when the furnace is evacuated, by radiation from the electrical heating elements above the hearth and when the vessel is pressurized by convection from the electrical heating elements below the hearth. Preferably, apparatus according to this invention is provided with a hollow pedestal having a plurality of downwardly directed openings therein such that means for evacuating the vessel are in direct communication with the interior of the pedestal and the outgassing contaminants are drawn directly down through the pedestal and exhausted from the vessel without contacting the heating elements and other structure that might be damaged by the outgassing contaminants. It is a preferred feature of this invention that a cold trap may be placed in the vessel below the pedestal.

In one particularly preferred embodiment of this invention, the vaccuum-pressure vessel comprises an elongate cylindrical vessel having closures at each end. A platform is spaced above the bottom of the vessel and a removable furnace bottom and attached pedestal for supporting a hearth is arranged to rest upon the platform. A cylindricl heating element and support therefor also rests upon the said bottom. An insulating hood encloses the heating elements and the workspace and fastens at the lower edge thereof to the furnace bottom such that by pulling the hood out of the vessel through the opening provided when the top closure is removed, the furnace bottom hood and workpiece may be removed from the vessel.

THE DRAWINGS

FIG. 1 is a side section view of an autoclave furnace according to this invention, FIG. 2 is a section taken along lines II—II in FIG. 1, and FIG. 3 is a section taken along lines III—III in FIG. 1.

DESCRIPTION OF THE PREFERRED EMBODIMENTS

Figure 1:
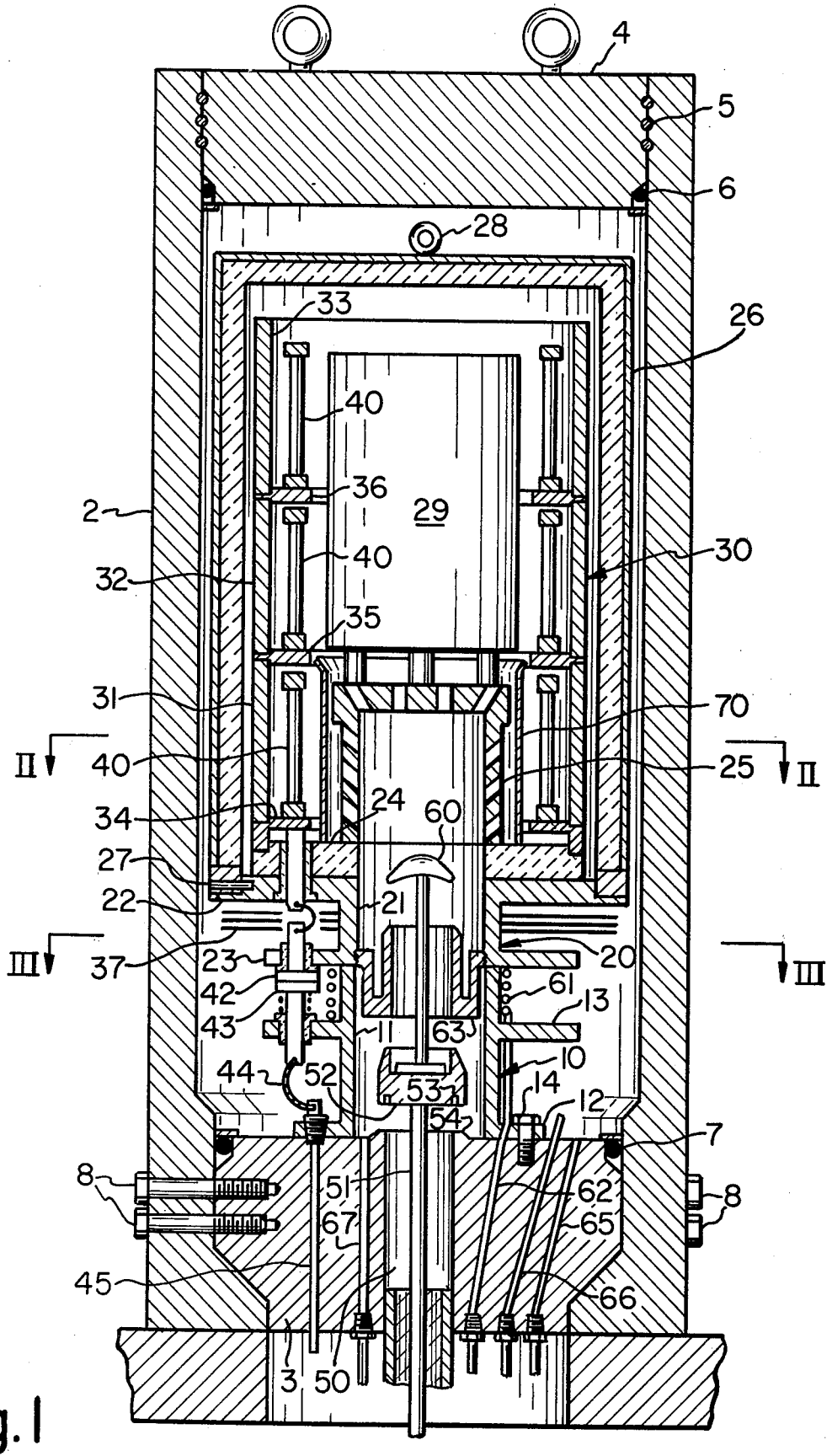
Figure 2:
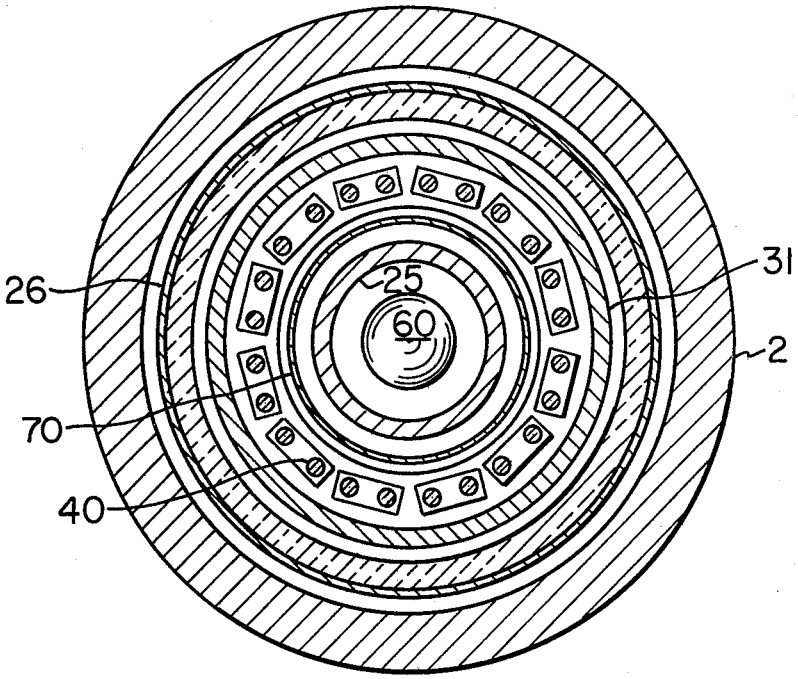
Figure 3:
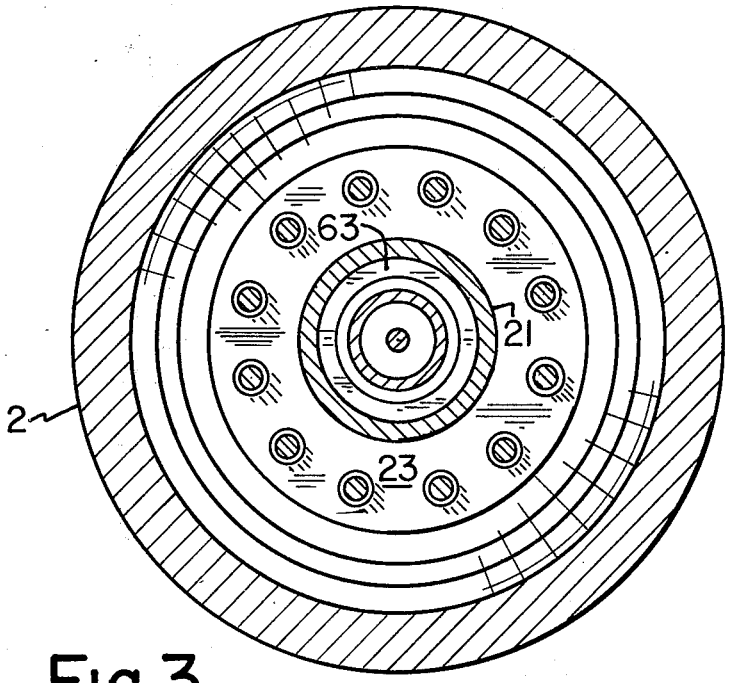

Referring now to FIG. 1, there is shown a vacuum-pressure vessel, comprising a cylindrical portion 2, bottom 3 nesting in the cylindrical portion and a removable top cover 4. Care is taken to assure that the seals 7 surrounding the bottom 3 and the seals 6 around the cover 4 are designed to withstand pressure from within the vessel and without. The top cover 4 is secured by a coiled spring worked into a helical groove 5 defined by both the cylindrical section and the cover. Plugs or bolts 8 hold the bottom from moving upward when a vacuum is drawn upon the vessel. The vessel is constructed of high strength steel.

Resting on the bottom of the vessel 3 is a lower foot 10. The lower foot is substantially a hollow cylinder with an annular base flange 12 and a centrally located annular flange 13 for holding certain electrical plugs or sockets as explained hereafter. The base flange 12 of the lower foot 10 may be bolted by bolts 14 to the bottom 3 of the furnace.

Resting on the lower foot 10 is an upper foot 20 comprising a hollow cylindricl section 21, and upper annular flange 22 which comprises a platform upon which the insulating furnace bottom rests. The upper foot 20 also has a lower annular flange 23 for holding certain electrical plug-sockets as explained hereafter. The upper foot and lower foot are constructed of structural steel or the like.

Resting directly upon the top of the upper flange 22 is an insulated furnace bottom 24 and pedestal 25. The furnace bottom 24 is a refractory insulating material—either a castable or brick. The pedestal and hearth are constructed of carbon or graphite. A heating insulating hood 26 comprises the remainder of the furnace enclosing the pedestal 25 and workspace and shielding the pedestal and workspace from the vessel 1. The hood is constructed of an outer steel shell and is lined with a refractory insulating material. The hood 26 has a hook or eye 28 which enables the hood to be engaged by a hook attached to a crane or hoist and withdrawn from the vessel. The hood 26 is releasably pinned by pins 27 at the lower edge to the upper foot 20. Thus, when the hood is withdrawn from the vessel, the upper foot 20, pedestal 25, and workpiece 29, if any, resting upon the pedestal are all withdrawn from the vessel.

Just below the upper flange 22 of the upper foot 20 are a plurality of reflecting heat shields 37 parallel to the surface of the flange. The shields help to maintain the area therebelow at a safe temperature during radiation heating, that is, when a vacuum is pulled on the vessel.

Within the hood 26 and surrounding the workspace and pedestal 25 is a cylindrical heating element support structure 30. It may be comprised of three hollow graphite cylinders 31, 32 and 33 spaced apart by interfitting axially spaced apart graphite rings 34, 35, and 36. An interior rim of the graphite rings is arranged and sized to fit within the inner wall of the graphite cylinders with which they are associated. The inner rim provides a location where graphite bar heating elements 40 or the like may be secured. The heating elements are connected substantially as described in our U.S. Pat. No. 4,126,757 entitled "Multizone Graphite Heating Element Furnace." The heating elements are electrically connected into at least two and preferably three independently controllable zones. The lowermost heating zone surrounds the pedestal 25 and the upper zones surround the workspace.

The heating elements have graphite rod or bar leads extending down through the insulated furnace bottom 24 where they are connected by cable to an electrical plug 42 which is mounted in the lower flange 23 of upper foot 20. The plug 42 cooperates with receptacle or socket 43 mounted in the upper flange 13 of the lower foot 10. A cable 44 connects the receptacle or socket 43 to an electrical power lead-through 45 in the bottom 3 of the vessel. There are, of course, a plurality of plugs 42, and sockets 43, cables 44 and lead-throughs 45.

Through the base 3 of the vessel is a large passage 50 through which the vessel may be evacuated. A valve stem 51 passes through the passageway has at its upper end a valve stopper 52 with sealing ring 53 arranged to engage the valve seat 54. The top of the valve comprises a platform or seat for the base of an umbrella shaped deflector 60. The valve is actuated open by raising the valve stem. This is done hydraulically through apparatus which is not shown in the drawings. The valve stem must, of course, pass through a vacuum tight packing or be magnetically actuated. A vacuum pump or pumps are in communication with the passage 50 by fittings threaded to the base 3.

Cooling coils 61 are arranged around the upper end of the lower foot 10 and conduits 62 in connection therewith pass out through the bottom 3 of the vessel. Secured to the upper foot 20 is a catch pot 63. The catch pot is in the shape of an annular trough and is fabricated of metal. The cooling coils 61 are for the principal purpose of lowering the temperature of the catch pot 63, the upper foot and the lower foot.

The passages in the bottom of the vessel define a pressurizing port 65, a purge gas port 66 and a pressure letdown port 67. Fittings in the base 3 permit these ports to be connected to appropriate apparatus (not shown).

The furnace pedestal 25 is provided with a plurality of downwardly directed passages therein. These cooperate without gas guide 70 (constructed of a refractory metal such as Inconel or graphite) to protect the heating elements and their connections from outgas vapor which can either corrode the heating elements or cause unwanted deposits thereon. Outgas vapors are drawn downwardly through the holes in the pedestal and are deflected by the umbrella deflector 60 into the catch pot 63 wherein certain vapors solidify thus preventing contamination of the valve seat 54 and the evacuation system (not shown).

OPERATION

A typical vacuum sintering, hot isostatic process using the above described apparatus would comprise the following: The workpiece in a basket or the like is placed on the hearth which, along with the remainder of the furnace, is outside of the vessel. The insulation hood is then placed over the workpiece and pins are inserted at the bottom of the hood into the upper foot. The hood, workpiece, and furnace bottom (upper foot) are then lowered into the vessel with the electrical connections and thermocouples automatically engaging by proper alignment of the hood as it is lowered into the vessel. At this time, the vessel is closed and evacuated through opening 50. Then the at least one heating means comprising heating elements spaced above the hearth are controlled to raise the temperature of the workpiece. The temperature is raised as a function of the vacuum as follows: As the vacuum is continually monitored and if a surge of outgassing reduces the vacuum, heating is discontinued until the desired vacuum is again attained. The evacuation of the vessel being through the downwardly directed openings in the pedestal, outgassing contaminants such as metallic vapors are drawn directly downwardly through the pedestal openings and are deflected by the umbrella into the catch pot where the metallic vapors are condensed. When the desired temperature is reached sintering is allowed to continue for a prescribed hold time until by experience it is known that the workpiece no longer has substantial open porosity. It may be desirable to sweep the outgassing contaminants away from the workpiece by introducing purged gases through the purge port 66.

At this time, the stopper 52 is drawn down and the vessel is pressurized, for example, from a tank which had been previously pressurized to approximately 15,000 pounds per square inch. The pressurizing gases are introduced through port 65. A compressor may be required to make-up pressure not adequately supplied by the blowdown gas from the tank. A certain amount of immediate quenching of the workpiece will, of course, taking place depending upon the rate at which the pressurizing atmosphere is introduced into the vessel. At this time, the heating means surrounding the workspace are turned-off and the heating means below the hearth are turned-on. Only in this way can temperature uniformity in the workspace be attained. Of course, it may be desirable to slowly diminish the power supply to the heating elements above the hearth and slowly increase the power applied to the heating elements below the hearth. In fact, it may not be necessary to completely turn-off either group of heating elements during either vacuum sintering or during hot isostatic pressing.

After a predescribed soak period during which isostatic consolidation of the workpiece takes place, the vessel pressure is letdown through port 67. When the pressure in the vessel is neutral, the vessel may be opened and the hood workpiece and furnace bottom removed. Thereafter the hood is separated from the furnace bottom to recover the workpiece. While the furnace bottom is removed it is possible to service the catch pot if required as by removing metals which have condensed from vapors.

Having thus defined our invention in the detail and with the particularity as required by the Patent Laws, what is desired protected by Letters Patent is set forth in the following claims.

We claim:

1. An apparatus for heating a workpiece at elevated temperatures both under vacuum and under superatmospheric pressures comprising:

(1) a vacuum-pressure vessel,
(2) a hood insulating the vessel from the workpiece,
(3) a pedestal extending up into the furnace,
(4) a first electrical heating means spaced about the pedestal entirely below the top of the pedestal,
(5) at least one second electrical heating means spaced about the workspace above the hearth,
(6) means for separately controlling the first and at least one second electrical heating means,
(7) means for connecting the interior of the vessel to means for pressurizing the vessel with a selected atmosphere, and
(8) means for connecting the interior of the vessel to means for evacuating the vessel to create a vacuum therein, whereby the furnace can provide substantially uniform temperture distribution to the workspace when the vessel is evacuated by radiation from the at least one second electrical heating means and when the vessel is pressurized by convection from the first electrical heating means.

2. The apparatus according to claim 1 wherein the pedestal is hollow and perforated and the means for connecting the interior of the vessel with means for evacuating the vessel is in direct communication with the interior of the pedestal.

3. The apparatus according to claim 2 wherein an outgas guide is positioned between the pedestal and the first heating means.

4. The apparatus according to claims 1, 2, or 3 wherein a cold trap is placed in the vessel directly below and in communication with the interior of the hollow pedestal.

5. The apparatus according to claim 4 wherein the cold trap is an annular trough opening upwardly.

6. The apparatus according to claim 5 further comprising a deflector between the hollow interior of the pedestal and the cold trap for deflecting gases drawn downwardly from the hollow interior of the pedestal into the cold trap.

7. Apparatus according to claim 4 wherein cooling coils are positioned in the vicinity of the cold trap which coils are in communication with extensions passing out of the vessel bottom.

8. An apparatus for treating a workpiece at elevated temperatures both undr a vacuum and under superatmospheric pressures comprising:

(1) an elongate cylindrical vacuum-pressure vessel,
(2) a foot extending above the bottom of the vessel,
(3) a removable furnace bottom and attached pedestal for supporting a workpiece, said pedestal arranged to rest upon the foot,
(4) a cylindrical heating element and support therefor resting on said bottom, and
(5) an insulating hood for enclosing the heating elements and workspace which fastens at the lower edge thereof to the furnace bottom such that by pulling the hood out of the vessel, the furnace bottom, hood and workpiece may be removed from the vessel.

9. An apparatus according to claim 8 further comprising a perforated hollow pedestal resting upon the furnace bottom, said bottom having an upening under said pedestal, whereby exhausting gas can be drawn downwardly through the pedestal.

10. An apparatus according to claim 9 wherein a cold trap is positioned below the hollow pedestal.

11. An apparatus according to claims 9 or 10 wherein the heating element comprises at least two individually controllable zones, one zone above the pedestal and one zone adjacent the pedestal.

* * * * *